US005486094A

United States Patent [19]

Davis, Jr. et al.

[11] Patent Number: 5,486,094

[45] Date of Patent: Jan. 23, 1996

[54] CEILING FAN BLADE MOUNTING BRACKET AND SUPPORT ARMS PROVIDING TWO FAN BLADE SUPPORT POINTS

[75] Inventors: William S. Davis, Jr.; Julia A. Morrow, both of Fort Worth, Tex.

[73] Assignee: Davoil, Inc., Fort Worth, Tex.

[21] Appl. No.: 386,281

[22] Filed: Feb. 9, 1995

[51] Int. Cl.[6] ..... F04D 29/34

[52] U.S. Cl. ..... 416/210.R; 416/214 R; 416/5

[58] Field of Search ..... 416/5, 170 R, 416/204 R, 210 R, 214 R

[56] References Cited

U.S. PATENT DOCUMENTS 4,053,260 10/1977 Yee ..... 416/210 R

FOREIGN PATENT DOCUMENTS 1067871 12/1979 Canada ..... 416/210
1428276 1/1969 Germany ..... 416/210

OTHER PUBLICATIONS

Ten pp. from Minka Aire Catalog (pp. 8, 9, 10, 11, 12, 13, 31, 65, front and back covers), Design Copyright 1993.
One page of drawings from a Taiwanese patent relating to a ceiling fan (no date).

*Primary Examiner*—Edward K. Look
*Assistant Examiner*—Christopher Verdier
*Attorney, Agent, or Firm*—James E. Bradley; Mark W. Handley

[57] ABSTRACT

A method and apparatus are provided for mounting fan blades to a ceiling fan with a mounting bracket and support arms which support each of the fan blades at two separate points. The mounting bracket is mounted to a motor for the ceiling fan and rotates in response to powering the motor. The fan blades are each secured to the mounting bracket at first points. The support arms have inward portions which are rigidly secured to the mounting bracket. The support arms extend from beneath the fan blades in a spaced apart relation with the fan blades. The support arms extend outward from a central axis for the ceiling fan to second support points on the lower sides of the ceiling fan blades. The second support points are disposed outward from the mounting brackets for reinforcing mounting of the fan blades to the motor. In a preferred embodiment, the mounting bracket includes decorative medallions for fitting beneath the fan blades to secure the fan blades and the support arms to the mounting bracket, and the support arms have decorative scrolled portions which extend beyond the decorative medallions.

9 Claims, 1 Drawing Sheet

CEILING FAN BLADE MOUNTING BRACKET AND SUPPORT ARMS PROVIDING TWO FAN BLADE SUPPORT POINTS

BACKGROUND OF THE INVENTION

1. Field of the Invention

This invention relates to ceiling fans, and in particular to support brackets for mounting fan blades to ceiling fans.

2. Description of the Prior Art

Prior art ceiling fans have fan blades which are mounted to motors for ceiling fans in a cantilevered type of arrangement. The blades for typical ceiling fans have inward ends which are secured to mounting brackets, and outward ends which extend radially outward from a central axis of rotation for the ceiling fan. The fan blades are configured for rotating around the central axis and moving air in response to powering the motor for the ceiling fan.

Fan blade mounting brackets for prior art ceiling fans typically include support arms which extend between the motor and the radially inward portions for the fan blades. The support arms are usually bolted to the motor. Some prior art support arms extend to the top side of the inward portions for ceiling fan blades. Decorative medallions may be placed for extending along the bottom, or lower flat sides, of the fan blades. Some decorative medallions are secured to the support arms with screws or bolts which extend through the fan blades. In this type of arrangement, the decorative medallions are typically metal plates which are clamped to the upper support members with the ceiling fan blades sandwiched therebetween to secure the ceiling fan blade to the mounting bracket. Only one continuous support point, or contact region, is provided for each of the fan blades by such a mounting arrangement. The singular support points are defined by the surface area of the contact region between the decorative medallions and the bottom of the fan blades.

These single support points, or regions, are typically flat, or planar surfaces. When a fan blade in this type of prior art, cantilevered mounting arrangement initially begins to wobble in response to an imbalance in the fan blades, portions of the singular planar surface of the fan blade may separate from the singular planar surface of the medallion. There is usually some play between the planar surfaces that will allow fan blades to wobble, even if extended planar contact surfaces are provided between the mounting brackets and the fan blades. The contact surfaces, even those extending over larger regions, will not be perfectly parallel. Even those mated contact surfaces which are close to parallel may wear and move away from parallel alignment. This will allow the fan blades to wobble some, since the mating flat planar contact surfaces will contact along either a line of contact or a point contact as the fan blades are canted.

Arms and other protrusions may also be provided to extend from the medallions for decorative purposes. Some of these decorative arms and other protrusions extend between the medallion and the support arms, inward of the medallion in relation to the central axis of rotation for the ceiling fan. These decorative arms and protrusions do not provide second support regions which extend outward beyond the support regions provided by the medallions for prior art mounting brackets. Rather, these decorative arms and protrusions of mounting brackets for prior art ceiling fans merely extend between different portions of the mounting bracket having only a single planar contact surface.

SUMMARY OF THE INVENTION

A method and apparatus are provided for mounting fan blades to a ceiling fan with a mounting bracket and support arms which support each of the fan blades at two separate points. The mounting bracket is mounted to a motor for the ceiling fan and rotates in response to powering the motor. The fan blades are each secured to the mounting bracket at first points. The support arms have inward portions which are rigidly secured to the mounting bracket. The support arms extend from beneath the fan blades in a spaced apart relation with the fan blades. The support arms extend outward from a central axis for the ceiling fan to second support points on the lower sides of the ceiling fan blades. The second support points are disposed outward from the mounting brackets for reinforcing mounting of the fan blades to the motor. In a preferred embodiment, the mounting bracket includes decorative medallions for fitting beneath the fan blades to secure the fan blades and the support arms to the mounting bracket, and the support arms have decorative scrolled portions which extend beyond the decorative medallions.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
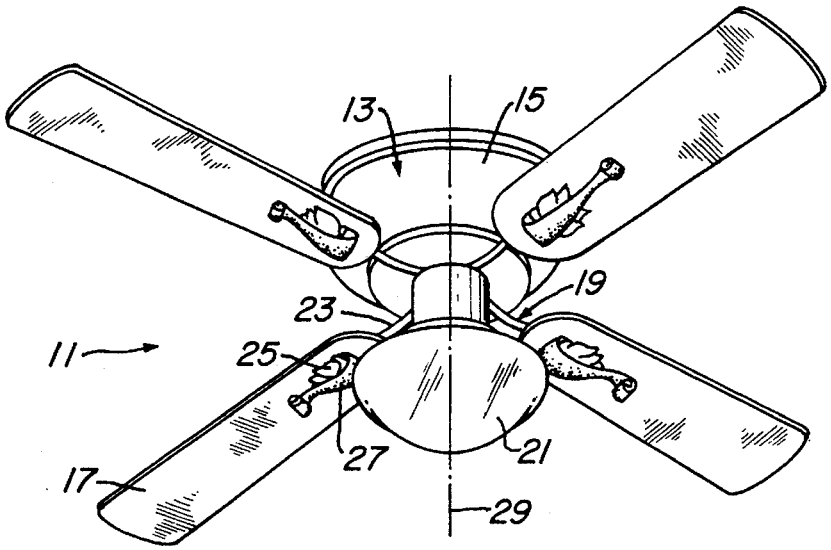
FIG. 1 is a perspective view of a ceiling fan made according to the present invention.

FIG. 1 is a perspective view of the ceiling fan 11, having motor 13, which is within motor housing 15. Four fan blades 17 are secured to motor 13 by mounting bracket 19. An optional light 21 is provided on the lower side of the ceiling fan 11. Mounting bracket 19 includes four upper support arms 23 and four decorative medallions 25. Decorative medallions 25 are metal castings which provide a lower plate for mounting bracket 19. Four lower support arms 27 are provided for adding additional support for fan blades 27. Support arms 27 are also provided by metal castings having decorative designs. Mounting bracket 19 and lower support arms 27 are provided for securing fan blades 17 to motor 13 and rotating with fan blades 17 around central axis 29 in response to powering motor 13.

Figure 2:
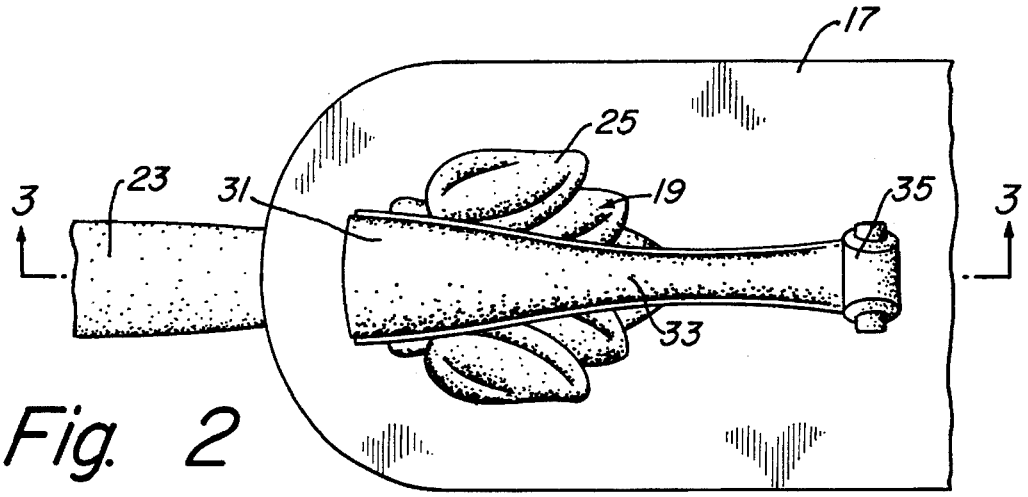
FIG. 2 is a partial, bottom view depicting one of the fan blades of the ceiling fan of FIG. 1.

FIG. 2 depicts a partial view of the bottom of one of fan blades 17. One of the lower support arm 27 is shown, and includes inner portion 31, central portion 33, and outer portion 35. In this preferred embodiment, outer portion 35 includes a decorative scroll design on the end.

Figure 3:
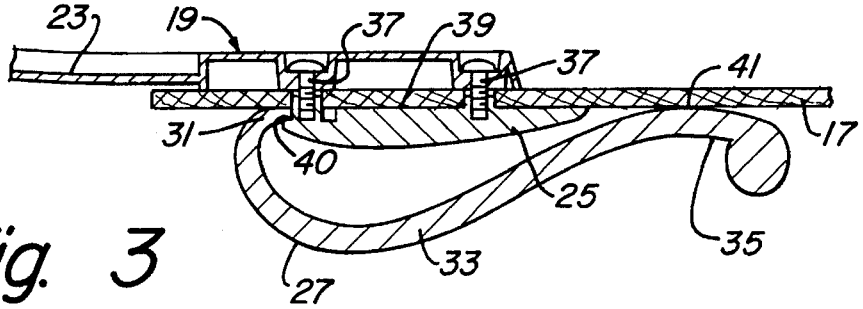
FIG. 3 depicts a partial sectional view of the fan blade of FIG. 2, taken along section line 3—3.

FIG. 3 depicts a sectional view of the one of fan blades 17 of which is shown in FIG. 2, taken along section line 3—3. A corresponding one of the upper supports 23 and a corresponding one of the medallions 25 illustrate the mounting for support arms 23 and medallions 25 of mounting bracket 19. Decorative medallions 25 are secured to corresponding ones of support arms 23 by fasteners 37, which in this embodiment of the present invention are depicted as screws which engage into threaded holes formed into medallion 25. A primary support point 39, as shown in FIG. 3, is defined by the flat, planar cross sectional area of the upper portion of medallions 25 engaging the lower portion of one of the blades 17. This cross sectional area provides the single support point, or region, by which each of fan blades 17 are secured to corresponding ones of medallions 25.

Inner portion 31 of lower support arm 27 is a separate member from medallion 25. Inner portion 31 is secured to mounting bracket 19 by fitting between a lower surface of fan blade 17 and shoulder 40, which is provided by an inner edge of medallion 25. Screws 37, when tightened, clamp the inner portion 31 between medallion 25 and blade 17. Lower support arms 27 are thus rigidly secured to mounting bracket 19 solely by being pressed between fan blades 17 and shoulders 40 of medallions 25, which are coupled to support arms 23 by fasteners 37. Central portion 33 of lower support arm 27 extends between inner portion 31 and scrolled outer portion 35 with an arcuate, or curved, shape. Central portion 33 extends in a spaced apart relation to both medallion 25 and the bottom, or lower, surface of fan blade 17. This provides a second contact point 41 which is outward from medallion 25 in relation to central axis 29 (shown in FIG. 1). Second support point 41 is defined by the contact surface area between the scrolled outer portion 35 for lower support arm 27 and the lower bottom of fan blade 17. Contact point 41 touches blade 17, but is not secured to it.

The present invention provides advantages over the prior art. Ceiling fans made according to the present invention have mounting brackets and support arms which provide two separate support points, or support regions, for each fan blade. The separate support points provide more than one singular set of planar contact surfaces for supporting each of the fan blades. Thus, as a fan blade begins to cant within the cantilevered arrangement by which it is secured to a ceiling fan motor, a second support point is provided. This separate support point reinforces securement of the fan blade to the motor for the ceiling fan and prevents the fan blade from wobbling. The separate, secondary support points are is disposed outward from a typical prior art mounting bracket support points, in the direction in which the cantilevered fan blades extend from the mounting bracket. Further, by making the medallion and support arms in two separate pieces, intricate ornamental castings can be made of the pieces.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

The claim:

1. In a ceiling fan of the type having a central axis, a motor mounted coaxially with the central axis, mounting brackets secured to the motor and extending outward from the motor and the central axis, and fan blades secured to the mounting brackets and extending outward from the mounting brackets in transverse relation to the central axis, wherein the fan blades and mounting brackets are secured to the motor for rotating the fan blades around the central axis and moving air in response to powering the motor, the improvement comprising in combination:

support arms having inward portions which are rigidly secured to the mounting brackets below the fan blades and which protrude from beneath the fan blades to extend away from corresponding ones of the fan blades;

the support arms having central portions which extend outward from the central axis and beyond the mounting brackets, in a spaced apart relation to the fan blades; and the support arms further having outward portions which extend toward and contact lower surfaces of the corresponding ones of the fan blades at contact points which are disposed outward from the mounting brackets to reinforce mounting of the fan blades to the mounting brackets.

2. The improvement according to claim 1, wherein the support arms extend beneath the fan blades with a curved shape.

3. The improvement according to claim 1, wherein the mounting brackets include plates which extend across inward surface areas of the lower portions of the fan blades for securing the fan blades to the motor.

4. In a ceiling fan of the type having a central axis, a motor mounted coaxially with the central axis, a plurality of mounting brackets secured to the motor and extending outward from the motor and the central axis, and fan blades which are mounted to the motor by means of the plurality of mounting brackets, an improvement for mounting each of the fan blades to one of the mounting brackets comprising:

a plate;

fastening means for securing the plate to one of the mounting brackets, with one of the fan blades sandwiched therebetween and the plate in contact with a lower surface of the fan blade;

a support arm having an inward portion which is secured to the plate and which protrudes from the plate to extend away from the fan blade;

the support arm having a central portion which joins the inward portion and extends outward from the central axis below and beyond the plate, in a spaced apart relation to the fan blade; and the support arm further having an outward portion which joins the central portion and extends generally upward towards and contacts a lower surface of the fan blade at a point which is disposed outward from the plate to reinforce mounting of the fan blade to the mounting bracket.

5. The improvement according to claim 4, wherein the inward portion for the support arm extends between the fan blade and inward end of the plate.

6. The improvement according to claim 4, wherein the inward portion for the support arm is clamped by the fastening means between the fan blade and a shoulder formed on the plate.

7. The improvement according to claim 4, wherein the central portion of the support arm extends from the inward portion and the plate with a curved shape.

8. A ceiling fan, comprising in combination:

a motor;

a plurality of mounting brackets;

a plurality of fan blades, each having an upper surface and a lower surface;

mounting means for mounting each of the fan blades to one of the mounting brackets;

the mounting means for each of the fan blades comprising a plate having an inward edge containing a shoulder, the plate being in abutment with the lower surface of the fan blade, and a plurality of fasteners extending from the plate, through the blade and into the mounting bracket; and the mounting means for each of the fan blades further comprising a support arm having an inward portion which is clamped by the fasteners between the shoulder of the plate and the lower surface of the fan blade, the support arm having a central portion extending below the plate, and the support arm further having an outer portion extending upward into contact with the blade at a point outward of the plate.

9. The ceiling fan according to claim 8, further comprising:

the central portion of the support arm extending from the inward portion to the outer portion with a curved shape.

* * * * *